US005589309A

United States Patent [19]

Suzuki et al.

[11] Patent Number: 5,589,309

[45] Date of Patent: Dec. 31, 1996

[54] ELECTROPHOTOGRAPHIC PHOTORECEPTOR CONTAINING PERYLENES

[75] Inventors: Tomoko Suzuki; Akira Kinoshita; Hirofumi Hayata; Tomoo Sakimura, all of Hino, Japan

[73] Assignee: Konica Corporation, Tokyo, Japan

[21] Appl. No.: 503,125

[22] Filed: Jul. 17, 1995

[30] Foreign Application Priority Data

Jul. 20, 1994 [JP] Japan ..... 6-168005

[51] Int. Cl.[6] ..... G03G 5/06; G03G 5/047

[52] U.S. Cl. ..... 430/59; 430/78

[58] Field of Search ..... 430/59, 78

[56] References Cited

U.S. PATENT DOCUMENTS

| | | | |
|---|---|---|---|
| 4,714,666 | 12/1987 | Wiedemann et al. | 430/59 |
| 4,968,571 | 11/1990 | Gruenbaum et al. | 430/59 |
| 5,019,473 | 5/1991 | Nguyen et al. . | |
| 5,141,837 | 8/1992 | Nguyen et al. | 430/135 |
| 5,330,865 | 7/1994 | Leus et al. | 430/78 |
| 5,338,637 | 8/1994 | Kinoshita et al. | 430/59 |

FOREIGN PATENT DOCUMENTS 0210521 2/1987 European Pat. Off. .

OTHER PUBLICATIONS

Borsenberger, Paul M. and David S. Weiss, Organic Photoreceptors for Imaging Systems. New York: Marcel–Dekker, Inc. pp. 330–338. 1993.

*Primary Examiner*—Christopher D. Rodee

*Attorney, Agent, or Firm*—Frishauf, Holtz, Goodman, Langer & Chick, P.C.

[57] ABSTRACT

Disclosed is an electrophotographic photoreceptor comprising a conductive support and provided thereon an intermediate layer, a carrier generation layer containing a carrier generation material and a carrier transportation layer containing a carrier transportation material, wherein said carrier generation layer contains a first perylene compound represented by Formula A and a second perylene compound represented by Formula B as said carrier generation material:

Formula A wherein Z represents a substituted or unsubstituted divalent aromatic hydrocarbon group or a substituted or unsubstituted divalent heterocyclic group; and R represents an alkyl group, an aralkyl group, a hydroxyalkyl group, an alkoxyalkyl group, an aromatic hydrocarbon group or a heterocyclic group;

Formula B

3 Claims, 1 Drawing Sheet

ELECTROPHOTOGRAPHIC PHOTORECEPTOR CONTAINING PERYLENES

FIELD OF THE INVENTION

The present invention relates to an electrophotographic photoreceptor, and more particularly to a highly sensitive photoreceptor effective for a printer and a copying machine.

BACKGROUND OF THE INVENTION

Heretofore, as an electrophotographic photoreceptor, there has widely been used an inorganic photoreceptor, wherein a light-sensitive layer whose main component is an inorganic photoconductive material such as selenium, zinc oxide and cadmium sulfate is provided. However, the inorganic photoreceptor is not always satisfactory in terms of properties such as light sensitivity, heat stability, resistance to humidity and durability that are requested for an electrophotographic photoreceptor of a copying machine. In addition, electrophotographic photoreceptors containing selenium and cadmium sulfate have a shortcoming in that they have severe restriction in manufacturing and handling due to their toxicity.

In order to overcome the above-mentioned shortcomings, there have been developed recently, electrophotographic photoreceptors using various organic photoconductive materials. Especially, a function-separation type electrophotographic photoreceptor wherein a carrier-generation function and a carrier-transportation function are assigned to different materials separately, is advantageous for enhancement of performance because of the appropriate substances can be selected from a wide range. Accordingly, it is dominant among organic photoreceptors in use practically currently.

As a carrier-generation material and a carrier-transportation material of the above-mentioned function-separation type electrophotographic photoreceptor, various organic compounds have been proposed. As a carrier-generation material, so far, various photoconductive materials such as polycyclic quinone compounds represented by dibromoanthanthlone, pyrylium compounds and euteric complexes of pyrylium compounds, photoconductive materials such as squarelium compounds, phthalocyanine compounds and azo compounds have been put into practical use. In addition, with regard to perylene compounds, Japanese Patent Publication Open to Public Inspection (hereinafter referred to as Japanese Patent O.P.I. Publication) No. 54267/1987 (U.S. Pat. No. 4,714,666) and Japanese Patent O.P.I. Publication No. 6014/1993 (U.S. Pat. No. 5,019,473) disclose technologies to use these compounds as carrier-generation materials.

As stated above, several experiments have been carried out. However, demand for enhancement of sensitivity of an electrophotographic photoreceptor has been increasing recently. Under these circumstance, the above-mentioned conventional technologies have not been considered satisfactory.

SUMMARY OF THE INVENTION

An object of the present invention is to provide an electrophotographic photoreceptor wherein sensitivity properties are excellent and quality is stable during production.

The object of the present invention can be attained by the following items.

Item 1: An electrophotographic photoreceptor comprising a conductive support and provided thereon an intermediate layer, a carrier generation layer containing a carrier generation material and a carrier transportation layer containing a carrier transportation material, wherein said carrier generation layer contains a first perylene compound represented by Formula A and a second perylene compound represented by Formula B as said carrier generation material:

Formula A

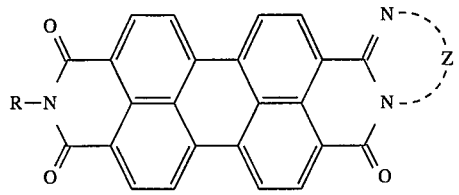

wherein Z represents a substituted or unsubstituted divalent aromatic hydrocarbon group or a substituted or unsubstituted divalent heterocyclic group; and R represents an alkyl group, an aralkyl group, a hydroxyalkyl group, an alkoxyalkyl group, an aromatic hydrocarbon group or a heterocyclic group;

Formula B

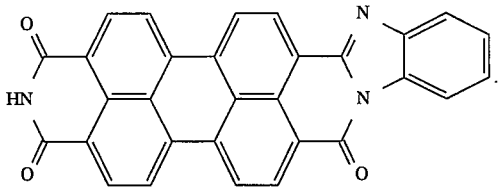

Item 2: The electrophotographic photoreceptor of item 1, wherein said Z group of said first perylene compound represents a phenylene, a naphthylene, an anthracenediyl, a phenanthlenediyl, a pyrydinediyl, a pyrimidinediyl or an anthraquinonediyl group, and said R of said first perylene compound represents an alkyl group having 1 to 6 carbon atoms or an aralkyl group having 7 to 10 carbons.

Item 3: The electrophotographic photoreceptor of item 1, wherein a weight ratio of said first perylene compound represented by Formula A to said second perylene compound represented by Formula B is equal to or more than 90/10.

Item 4: The electrophotographic photoreceptor of item 1, wherein said carrier transportation material is selected from the group consisting of the following Formula 3, 4, 5 and 6:

Formula 3:

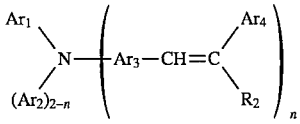

wherein $Ar_1$, $Ar_2$, $Ar_3$ and $Ar_4$ each represent an aromatic hydrocarbon group or heterocyclic group; $R_2$ represents a hydrogen atom or an aromatic hydrocarbon group or heterocyclic group; n is 1 or 2; and $Ar_4$ and $R_2$ may combine each other;

Formula 4:

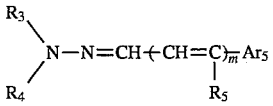

wherein $R_3$ and $R_4$ each represent an aromatic hydrocarbon group, heterocyclic group or alkyl group, which may combine one another; $R_5$ represent a hydrogen atom or an aromatic hydrocarbon group, heterocyclic group or alkyl group; $Ar_5$ represents an aromatic hydrocarbon group or heterocyclic group; and m is 0 or 1;

Formula 5:

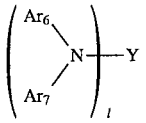

wherein Y represents a benzene, naphthalene, pyrene, fluorene, carbazole or 4,4'-alkylidene diphenyl group; $Ar_6$ and $Ar_7$ each represent an aromatic hydrocarbon group or heterocyclic group; and 1 is 1 to 3;

Formula 6:

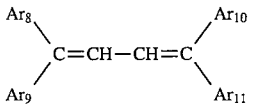

wherein $Ar_8$ , $Ar_9$, $Ar_{10}$ and $Ar_{11}$ each represent an aromatic hydrocarbon group or heterocyclic group.

EXPLANATION OF NUMERALS

Figure 1:
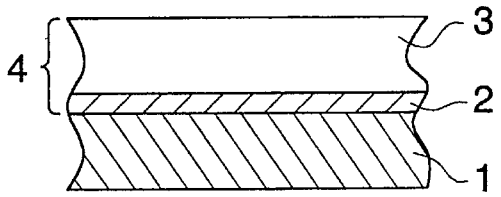
FIGS. 1(*a*)–1(*e*) are schematic diagrams showing embodiment of the layer structure of the photoreceptor of the present invention.
Figure 1:
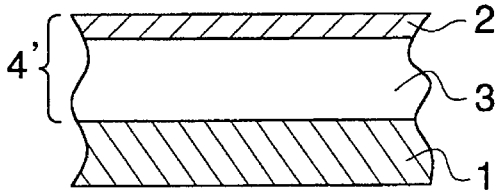
Figure 1:
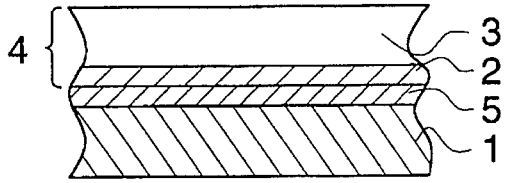
Figure 1:
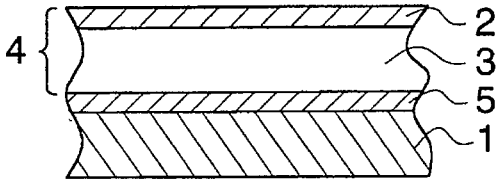
Figure 1:
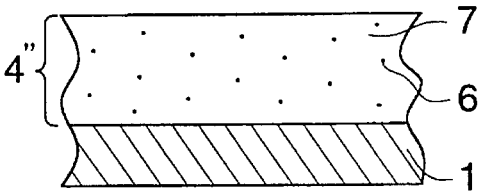
Figure 1:
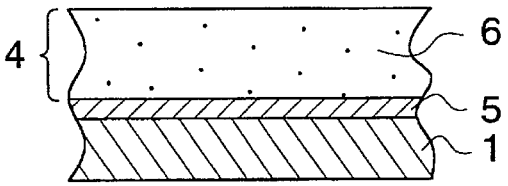

1. Electroconductive support
2. Carrier-generation layer
3. Carrier-transportation layer
4, 4', 4" Light-sensitive layer
5. Intermediate layer

DETAILED DESCRIPTION OF THE INVENTION

To meet the demand for enhancement of sensitivity of an electrophotographic photoreceptor, the present inventors studied compounds represented by the above-mentioned Formula [A] and compounds represented by the above-mentioned Structural Formula [B] as carrier-generation materials. As a result, they discovered that when both compounds are mixed to be used, rather than used independently, unexpected sensitization effect occurs and sensitivity properties are improved noticeably.

In addition to the sensitization, there is an another effect due to mixing a compound representedby the above-mentioned Formula A and a compound represented by the above-mentioned Formula B.

Generally, when a light-sensitive layer is formed by the use of a carrier generation material, the following two methods can be employed.

A first method is a vaccum evaporation method and a second method is a coating method that coats a dispersion of fine particles of the carrier generation material.

The vacuum evaporation method has the following problems; since the condition of crystals cannot be controlled, carrier-generation functions cannot be realized completely, and cost is high because productivity is low. Therefore, the method which coats the dispersion of fine particles of the carrier generation material is used more frequently. However, in the method which disperses for coating, a problem that the dispersion conditions are changed during storage of a dispersion solution so that the properties of the coated photoreceptor are lowered. With regard to this problem, it was discovered that, when a compound represented by the above-mentioned formula [A] and a compound represented by the above-mentioned Structural formula [B] are mixed to prepare a carrier-generation material, storage stability of dispersed solution is improved. Therefore, even when a photoreceptor is made using a dispersed solution after being stored for a long time is used, deterioration in terms of the properties of photoreceptor does not occur.

In the above-mentioned formula [A], the preferable groups represented by Z include a phenylene, naphthylene, anthracenediyl, phenanthrenediyl, pyridinedixl, pyrimidinediyl and anthraquinonediyl group. The groups especially preferable are phenylene group and a naphthylene group. The most preferable group is a phenylene group. As a substituent of an aromatic hydrocarbon group and a heterocyclic group represented by Z, an alkyl, alkoxy, aryl, aryloxy, acyl, acyloxy, amino, carbamoyl, halogen, nitro and cyano groups are cited. In addition, as R, an alkyl group having 1 to 6 carbons and an aralkyl group having 7 to 10 carbons are preferable.

In the present invention, when a perylene compounds represented by Formula [A] (hereinafter, referred to also as perylene compound A) and a perylene compound represented by Structural formula [B] (hereinafter referred to also as perylene compound B) are mixed to be used, unexpected sensitization effects occur compared to when they are used independently resulting in sensitivity properties that are noticeably improved.

Effects of mixing the perylene compound A and the perylene compound B, in addition to the sensitization effect, also include improvement of storage stability of a dispersion coating solution in the case when a carrier-generation material is dispersed in a dispersion solvent for manufacturing of photoreceptors. Generally, the condition of the dispersion of the carrier-generation material changes during storage so that the properties of the coated photoreceptor are degraded. However, when the perylene compound A and the perylene compound B are mixed, dispersion stability effects are resulted. Therefore, even when a photoreceptor is produced from a dispersion solution after being stored for a long time, the properties of the photoreceptor are only slightly degraded. Accordingly, an electrophotographic photoreceptor having stable qualities can be provided constantly.

A preferable ratio by weight A/B for mixing a perylene compound represented by Formula [A] and a perylene compound represented by Structural formula [B] is not less than 90/10.

In the present invention, a perylene compound represented by Formula [A] and a perylene compound represented by Structural Formula [B] can be synthesized by any conventional method, for example, by the method described in CHEMISTRY LETTERS, 151 (1979).

Hereunder, practical examples of compounds represented by Formula [A] are exemplified. Z and R respectively represent Z and R in Formula [A].

| No. | Z | R |
|---|---|---|
| A-1 | 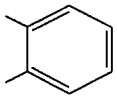 | $CH_3-$ |
| A-2 | 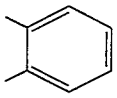 | $C_2H_5-$ |
| A-3 | 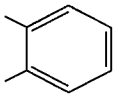 | $n\text{-}C_3H_7-$ |
| A-4 | 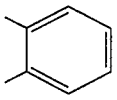 | $(CH_3)_2CH-$ |
| A-5 | 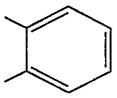 | $n\text{-}C_4H_9-$ |
| A-6 | 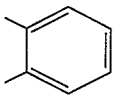 | $CH_3CH_2CH(CH_3)-$ |
| A-7 | 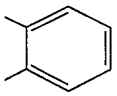 | $(CH_3)_2CHCH_2-$ |
| A-8 | 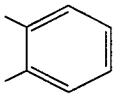 | $(CH_3)_3C-$ |
| A-9 | 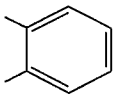 | $CH_3OCH_2CH_2-$ |
| A-10 | 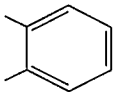 | $CH_3OCH_2CH_2CH_2-$ |
| A-11 | 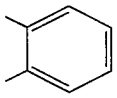 | 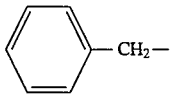 |
| A-12 | 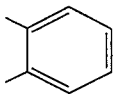 | 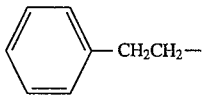 |
| A-13 | 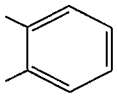 | 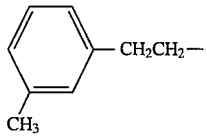 |
| A-14 | 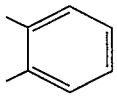 | 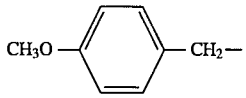 |

-continued
| No. | Z | R |
|---|---|---|
| A-15 | 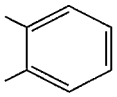 | 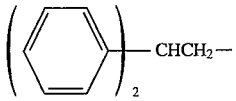 |
| A-16 | 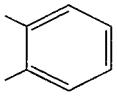 | 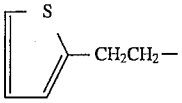 |
| A-17 | 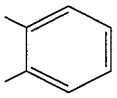 | 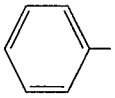 |
| A-18 | 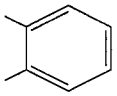 | 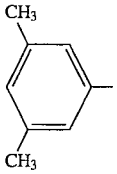 |
| A-19 | 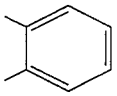 | $HOCH_2CH_2CH_2-$ |
| A-20 | 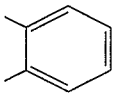 | $CH_3CH_2\underset{\underset{CH_3}{\vert}}{C}HCH_2-$ |
| A-21 | 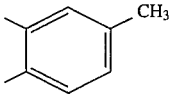 | $H-$ |
| A-22 | 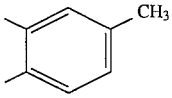 | $CH_3-$ |
| A-23 | 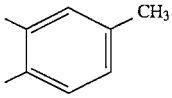 | $n\text{-}C_3H_7-$ |
| A-24 | 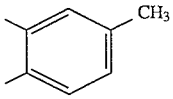 | $n\text{-}C_5H_{11}-$ |
| A-25 | 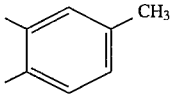 | $CH_3CH_2\underset{\underset{CH_3}{\vert}}{C}HCH_2-$ |
| A-26 | 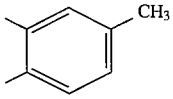 | 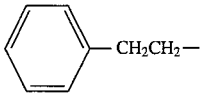 |
| A-27 | 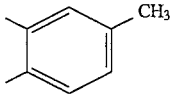 | 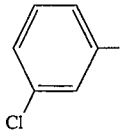 |

-continued
| No. | Z | R |
|---|---|---|
| A-28 | 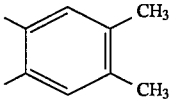 | H— |
| A-29 | 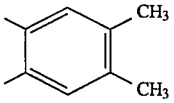 | $C_2H_5$— |
| A-30 | 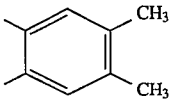 | 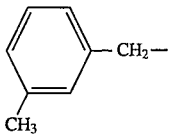 |
| A-31 | 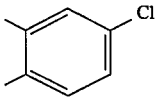 | $CH_3$— |
| A-32 | 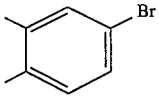 | n-$C_3H_7$— |
| A-33 | 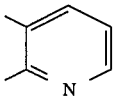 | H— |
| A-34 | 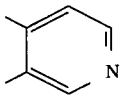 | 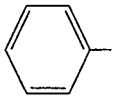 |
| A-35 | 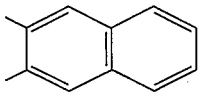 | $C_2H_5$ |
| A-36 | 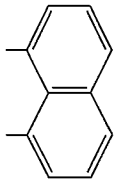 | $CH_3OCH_2CH_2$— |
| A-37 | 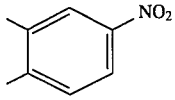 | H— |
| A-38 | 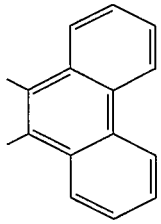 | H— |
| A-39 | 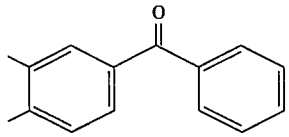 | $CH_3$— |

-continued

| No. | Z | R |
|---|---|---|
| A-40 | 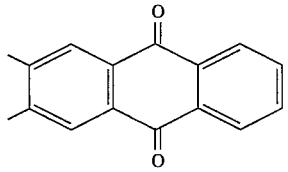 | $CH_3-$ |

In the present invention, there are several methods that incorporate the perylene compound representedby Formula [A] and the perylene compound represented by Structural Formula [B]. For example, each compound can either be mixed as a solid state in preparing a coating solution or can be dissolved by means of an acid pasting process, to be formed as mixed crystals.

In the present invention, other carrier-generation materials may also be used in combination, in addition to the above-mentioned compounds. The carrier-generation materials include a phthalocyanine pigment, an azo pigment, an anthraquinone pigment, a perylene pigment, a polycyclic quinone pigment and a squarelium pigment.

Various kinds of materials can be used for a carrier-transportation material in the electrophotographic photoreceptor of the present invention. Typically, nitrogen-containing heterocycles such as oxazol, oxadiazol, thiazol, and imidazole and compounds having its condensed ring nuclei, polyarylalkane type compounds, pyrazoline type compounds, hydrazine type compounds, triarylamine type compounds, styryl type compounds, styryltriphenylamine compounds, β-phenylstyryltriphenylamine type compounds, butadiene type compounds, hexatriene type compounds, carbazole type compounds and condensed polycyclic type compounds are cited. Practical examples of the above-mentioned carrier transportation compounds include the carrier transportation materials described in Japanese Patent O.P.I. Publication No. 107356/1976. Especially, typical ones are shown as follows:

(T-1)

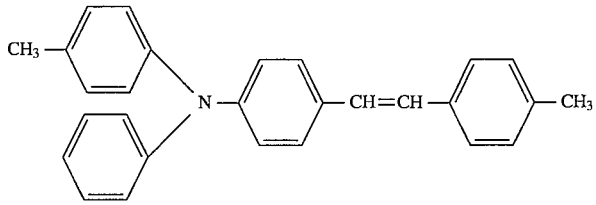

(T-2)

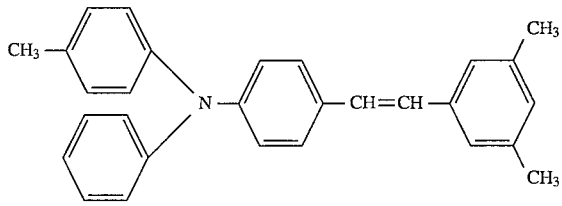

(T-3)

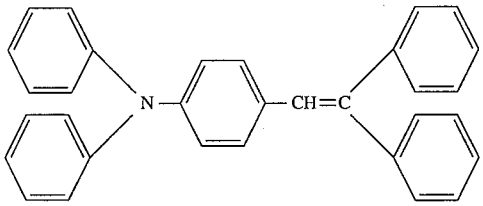

(T-4)

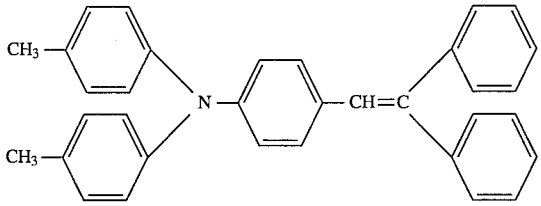

-continued
(T-5)
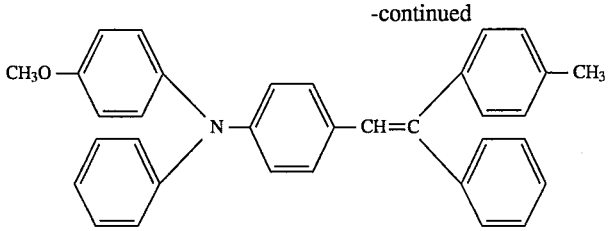
(T-6)
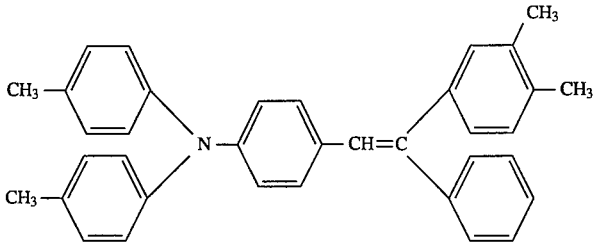
(T-7)
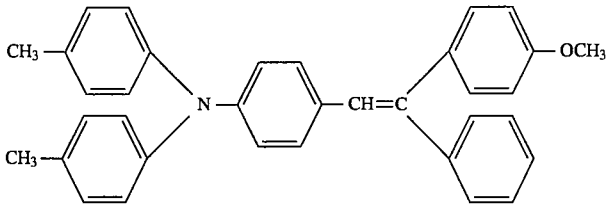
(T-8)
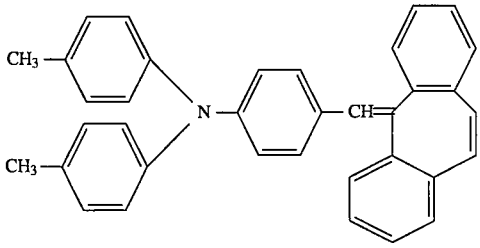
(T-9)
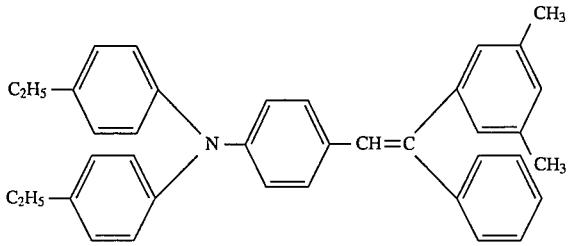
(T-10)
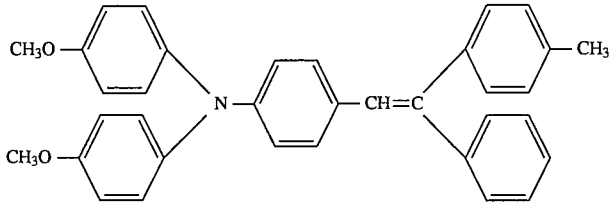
(T-11)
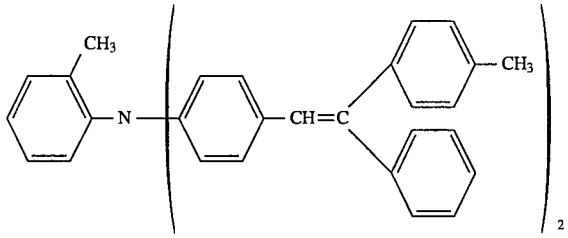

-continued
(T-12)
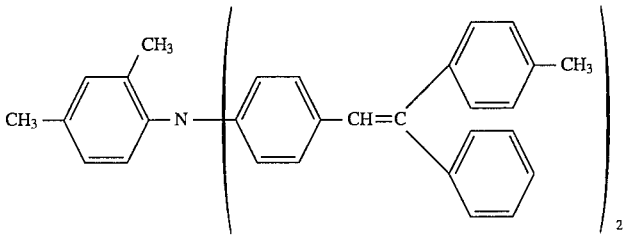
(T-13)
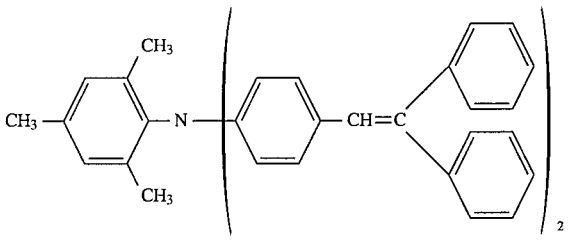
(T-14)
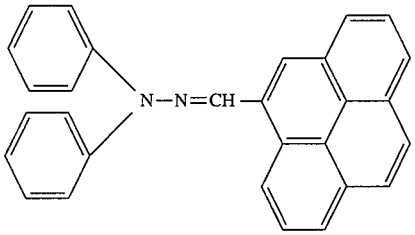
(T-15)
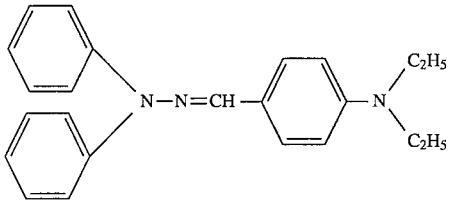
(T-16)
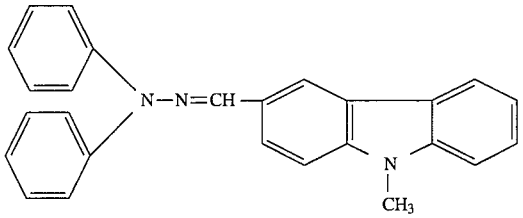
(T-17)
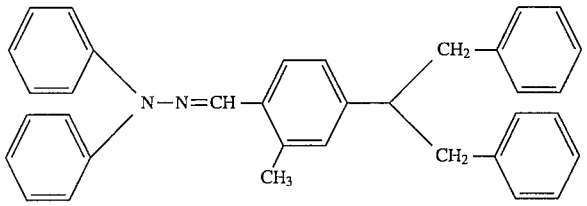
(T-18)
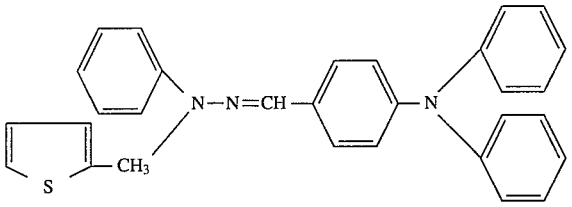

-continued
(T-19)
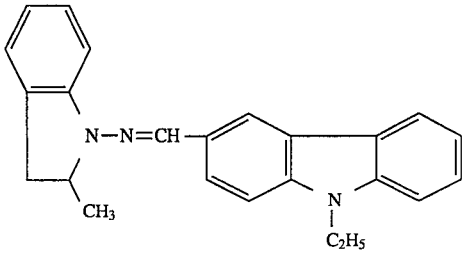
(T-20)
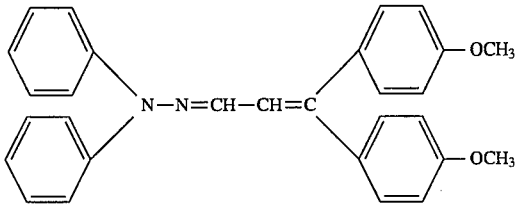
(T-21)
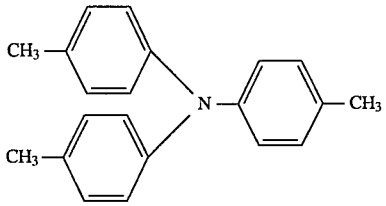
(T-22)
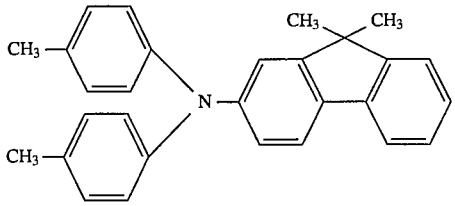
(T-23)
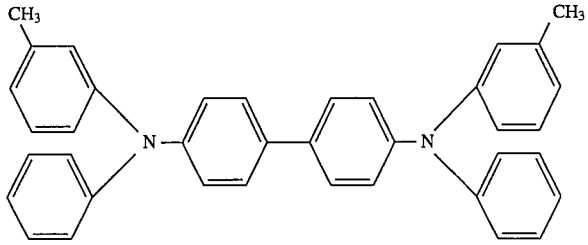
(T-24)
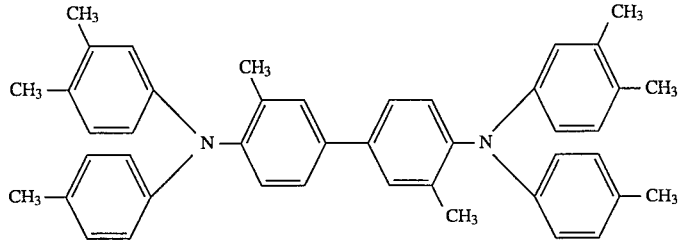
(T-25)
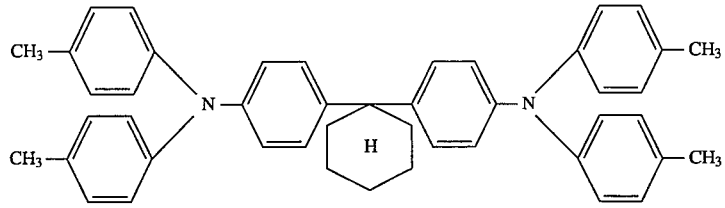

-continued

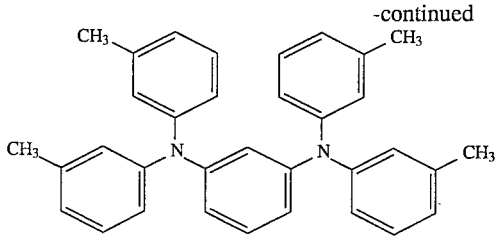

(T-26)

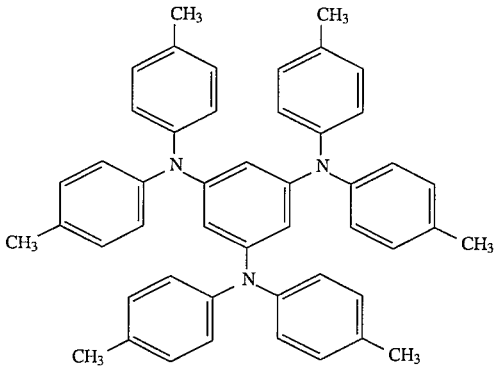

(T-27)

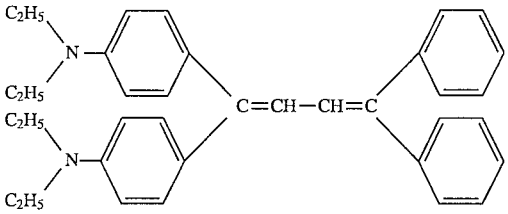

(T-28)

As a constitution of the electrophotographic photoreceptor, various styles have been known. The electrophotographic photoreceptor of the present invention can take any style. It is desirable to be a function-separation type photoreceptor of a multi-layered type or a dispersion type. In this case, the constitution is as shown in (a), carrier-generation layer 2 is formed on electroconductive support 1. To this, a carrier transportation layer 3 is coated to form a light-sensitive layer 4 is formed. In (b), light-sensitive layer 4' wherein carrier-generation layer 2 and carrier-transportation layer 3 are located reversely. In (c), between light-sensitive layer 4' of layer constitution (b) and conductive support 1, an intermediate layer 5 is provided. In layer constitution (e), there is formed light-sensitive layer 4", containing carrier-generation material 6 and carrier-transportation material 7. In (f), intermediate layer 5 is provided between light-sensitive layer 4" and conductive support 1.

In forming a light-sensitive layer, a first method that coats a dispersion, wherein a carrier generation material independently dispersed in a suitable dispersion solvent alone or together with a binder and an additive or a second method that vacuum deposits a carrier generation material, can be used.

In the former case, as a dispersion means, dispersion devices such as a supersonic disperser, a ball mill, a sandmill and a homomixer can be used. In addition, as a carrier-transportation layer, a method that coats a solution wherein carrier-transportation material is dissolved independently or wherein it is dissolved together with a binder and an additive is cited.

When a binder is used for forming the carrier-generation layer or the carrier transportation layer, any of polymers can be selected as a binder. Specifically, a hydrophobic high polymer having a high film forming ability is preferable. As such a polymer, the following can be coated. However, the invention is not limited thereto.

| | |
|---|---|
| polycarbonate | polycarbonate Z resin |
| acrylic resin | methacrylic resin |
| polyvinyl chloride | polyvinylidene chloride |
| polystyrene | styrene-butadiene copolymer |
| polyvinyl acetate | polyvinyl formal |
| polyvinyl butylal | polyvinyl acetal |
| polyvinyl carbazol | styrene-alkyd resin |
| silicones resin | silicone-alkyd resin |
| polyester | phenol resin |
| polyurethane | epoxy resin |
| vinylidene chloride - acrylonitrile copolymer | |
| vinyl chloride - vinyl acetic acid copolymer | |
| vinyl chloride - vinyl acetic acid maleic acid anhydride copolymer | |

The proportion of the carrier-generation material to the binder is preferably 10 to 600 parts by weight and more preferably 50 to 500 parts by weight per 100 parts by weight of binder, and the proportion of carrier transportation material is preferably 10 to 500 parts by weight per 100 parts by weight of the binder. The thickness of the carrier-generation layer is 0.01 to 20 μm, and preferably 0.05 to 5 μm. The thickness of the carrier-transportation layer is 1 to 100 μm, and preferably 5 to 50 μm.

As the binder used for an intermediate layer and a protective layer, those cited for the above-mentioned carrier-generation layer and the carrier-transportation layer can be used. In addition to these, polyamide resins, nylon resins, ethylene resins such as ethylene-vinyl acetic acid copolymer, ethylene vinyl acetic acid maleic acid anhydride copolymer and ethylene vinyl acetic acid methacrylic acid copolymer, polyvinyl alcohol and cellulose derivatives are effective. Hardening binders utilizing thermo-hardening or chemical-hardening such as meranine, epoxy and isocyanate can also be used.

As an electrophotoconductive support, a metal plate and a metal drum are used. In addition, a paper or a plastic film on which electroconductive compounds such as an electroconductive polymer and indium oxide, or a thin layer of metal such as aluminum or palladium is coated, vapor-deposited or laminated can be used.

The photoreceptor of the present invention has the above-mentioned constitution and it is excellent in terms of sensitivity properties and quality stability, as is apparent from the following examples.

EXAMPLE

SYNTHESIS EXAMPLE 1

3.9 g of perylene-3,4,9,10-tetracarboxylic acid dianhydride, 5.3 g of n-propylamine and 100 ml of water were mixed and stirred for 3 hours at 50° C. After reaction, hydrochloric acid was added to the mixture so that precipitation was filtrated and washed with water. Following this, the resulting substance was dissolved in a 1% aqueous potassium hydroxide solution. The mixture was heated and filtrated and alkaline insoluble was removed. To the filtrated solution, potassium chloride was added in a manner to obtain the density of 10%. The precipitated precipitant was filtrated and unreacted raw material being dissolved was removed. The resulting precipitant was dissolved in a 1% aqueous potassium hydroxide solution and potassium chloride was added thereto, and salting out was repeated for refining. Finally, hydrochloric acid was added for precipitation. The precipitated substance was washed with water and dried so that 3.0 g of perylene-3,4,9,10-tetracarboxylic acid monoanhydride-monopropylimide was obtained. This was mixed with 1.1 g of o-phenylenediamine and 50 ml of α-chloronaphthalene. The mixture was subjected to heated and refluxed for 3 hours. The precipitated crystals were filtrated and subjected to methanol washing. After the resulting substance was dried, it was sublimated for refining so that 3.0 g of illustrated compound A-3 of perylene compound A was obtained.

SYNTHESIS EXAMPLE 2

Some 3.9 g of perylene-3,4,9,10-tetracarboxylic acid dianhydride, 60 g of a 28% aqueous ammonia and 100 ml of water were mixed and stirred for 1 hour at room temperature. After reaction, hydrochloric acid was filtrated and washed with water. Following this, the resulting substance was dissolved in a 1% aqueous potassium hydroxide solution. The mixture was heated and filtrated, and alkaline insoluble was removed. To the filtrated solution, potassium chloride was added in a manner to obtain the density of 10%. The precipitated precipitant was filtrated and unreacted raw material being dissolved was removed. The resulting precipitant was dissolved in a 1% aqueous potassium hydroxide solution and potassium chloride was added thereto, and salting out was repeated for refining. Finally, hydrochloric acid was added for precipitation. The precipitated substance was washed with water and dried so that 2.7 g of perylene-3,4,9,10-tetracarboxylic acid monoanhydride-monoimide was obtained. This was mixed with 1.1 g of o-phenylenediamine and 50 ml of α-chloronaphthalene. The mixture was subjected to heated and refluxed for 3 hours. The precipitated crystals were filtrated and subjected to methanol washing. After the resulting substance was dried, it was sublimated for refining so that 2.4 g of perylene compound B was obtained.

EXAMPLE 1

By the use of a sandmill, 0.999 parts by weight of illustrated compound A-3, 0.001 parts by weight of the above-mentioned perylene compound B, 0.3 parts by weight of polyvinyl butyral "Eslec BL-1" as a binder resin and 40 parts by weight of methylethylketone were dispersed. The resulting substance was coated by the use of a wire bar on a polyester film on which aluminum is vapor-deposited so that a carrier-generation layer having a layer thickness of 0.6 μm was formed. On the layer, a solution wherein 1 part by weight of carrier-transportation material T-3, 1.3 parts by weight of polycarbonate resin (Yupilon Z200) (produced by Mitsubishi Gas Kagaku Co., Ltd.) and a very small amount of silicone oil "KF-54" (produced by Shinetsu Kagaku Co., Ltd.) were dissolved in 10 parts by weight of 1,2-dichloroethane was coated by the use of a blade coating machine. After drying, a carrier-transportation layer having a layer thickness of 25 μm was formed. Electrophotographic photoreceptor thus obtained was defined to be Sample 1.

EXAMPLES 2 AND 3

In the same manner as in Example 1 except that illustrated compound A-3 and perylene compound B were used in weight ratio shown in Table 1 (1 part by weight totally), an electrophotographic photoreceptor was prepared. They were defined respectively as Samples 2 and 3.

COMPARATIVE EXAMPLE 1

In the same manner as in Example 1 except that perylene compound B was not used and illustrated compound A-3 was used by 1 part by weight, an electrophotographic photoreceptor was prepared. This was defined to be comparative sample 1.

COMPARATIVE EXAMPLE 2

In the same manner as in Example 1 except that perylene compound A-3 was not used and illustrated compound B was used by 1 part by weight, an electrophotographic photoreceptor was prepared. This was defined to be comparative sample 2.

COMPARATIVE EXAMPLE 3

In the same manner as in Example 2 except that the following compound G-1 was used in place of perylene compound B, an electrophotographic photoreceptor was prepared. This was defined to be comparative sample 3.

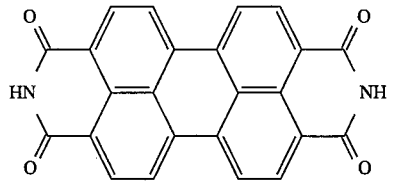

(G-1)

EXAMPLE 4

In the same manner as in Example 2 except that illustrated compound A-5 was used in place of A-3, an electrophotographic photoreceptor was prepared. This was defined to be Sample 4.

EXAMPLE 5

In the same manner as in Example 2 except that illustrated compound A-20 was used in place of illustrated compound A-3, an electrophotographic photoreceptor was prepared. This was defined to be Sample 5.

COMPARATIVE EXAMPLE 4

In the same manner as in Example 4 except that perylene compound B was not used and 1 part by weight of illustrated compound A-5 was used, an electrophotographic photoreceptor was prepared. This was defined to be comparative sample 4.

COMPARATIVE EXAMPLE 5

In the same manner as in Example 5 except that perylene compound B was not used and 1 part by weight of illustrated compound A-20 was used, an electrophotographic photoreceptor was prepared. This was defined to be comparative sample 5.

EVALUATION 1

The sensitivity of samples obtained in the above-mentioned manner was measured by the use of a paper analyzer EPA-8100 (produced by Kawaguchi Denki Co., Ltd.). First of all, the samples were subjected to corona charging at −6 kV. Following this, by the use of a halogen lamp, the samples were exposed to light in a manner that the surface of sample be 2 lux for obtaining an necessary exposure amount $E_{600/100}$ for reducing the surface potential from −600 V to −100 V. Table 1 shows the result thereof.

TABLE 1

| Sample Name | Carrier generating material | Mixture ratio | $E_{600/100}$ (lux · sec) |
|---|---|---|---|
| Sample 1 | A-3/B | 0.999/0.001 | 1.24 |
| Sample 2 | A-3/B | 0.99/0.01 | 1.19 |
| Sample 3 | A-3/B | 0.9/0.1 | 1.16 |
| Comparative sample 1 | A-3 | 1 | 1.43 |
| Comparative sample 2 | B | 1 | 1.61 |
| Comparative sample 3 | A-3/G-1 | 0.99/0.01 | 1.52 |
| Sample 4 | A-5/B | 0.99/0.01 | 1.12 |
| Comparative sample 4 | A-5 | 1 | 1.50 |
| Sample 5 | A-20/B | 0.99/0.01 | 1.49 |
| Comparative sample 5 | A-20 | 1 | 1.74 |

As is apparent from the above-mentioned examples, when perylene compound A and perylene compound B are mixed to be used, noticeable enhancement of sensitization can be obtained compared to when perylene compound A or perylene compound B is used independently.

EXAMPLE 6

Into a molybdenum boat for sublimation, 0.95 parts by weight of illustrated compound A-8 and 0.05 parts by weight of perylene compound B were placed. Under the degree of vacuum of $10^{-5}$ torr and the deposition-source temperature of 400° C., a carrier generation layer of 0.3 μm was obtained. Next, in the same manner as in Example 1, a carrier transportation layer was formed so that an electrophotographic photoreceptor was prepared. When this sample was measured in accordance with Evaluation 1, $E_{600/100}$ was 1.54 (lux·sec).

COMPARATIVE EXAMPLE 6

An electrophotographic photoreceptor was prepared in the same manner as in Example 6 except that perylene compound B was not used and illustrated compound A-8 was independently subjected to vacuum deposition. In accordance with Evaluation 1, sensitivity was measured. $E_{600/100}$ was 1.78 (lux·sec).

EXAMPLE 7 THROUGH 9

Illustrated compound A-3 and perylene compound B in a weight ratio as shown in Table 2 (1 part by weight in total) were dispersed by the use of a sandmill together with 0.3 part by weight of polycarbonate "Pan light L1250" (produced by Teijin Kasei Co., Ltd.) and 50 parts by weight of 1,2-dichloroethane as a dispersion solvent for obtaining a dispersion for a carrier generating layer. The resulting dispersion was coated on a polyester film wherein aluminum was vapor-deposited by the use of a wire bar for obtaining a carrier-generation layer having a layer thickness of 0.4 μm. On this, a solution wherein 1 part by weight of a carrier transportation material T-3, 1.3 parts by weight of polycarbonate resin "Yupilon Z300" (produced by Mitsubishi Gas Chemical Co., Ltd.) and a very small amount of silicone oil "KF-54" (produced by ShinEtsu Kagaku Co., Ltd.) was dissolved in 10 parts by weight of 1,2-dichloroethane by the use of a blade coating machine and dried so that a carrier transportation layer having a layer thickness of 31 μm was formed. Thus, an electrophotographic photoreceptor was obtained. This is called "just-after-production" sample. On the other hand, the dispersion for coating the carrier-generation layer obtained here was left for 5 days at 50° C. for a storage stability deteriorating test. Next, in the same manner as in the above except for using this dispersion solution, an electrophotographic photoreceptor was prepared. This is called a "stored" sample.

COMPARATIVE EXAMPLE 7

In the same manner as in Example 7 except that a dispersion solution was prepared not using perylene compound B but using 1 part by weight of illustrated compound A-3, a just-after-production sample and a stored sample were obtained.

EVALUATION 2

These samples were evaluated by the use of a paper analyzer EPA-8100 (produced by Kawaguchi Denki Co., Ltd.) in the following manner. First of all, they were subjected to corona charging for 5 seconds at −6 kV so that the surface potential of immediately after being charged Va and that after 5 seconds Vi were obtained. Succeedingly, by the use of a halogen lamp, they were subjected to exposure in a manner that the surface illuminance be 2 lux. By means of an equation of DD=100 (Va−Vi)/Va, a dark decay rate DD was obtained. An exposure amount $E_{600/100}$ necessary to reduce the surface potential from −600 V to −100 V was calculated. Thus, the just-after-production sample and the stored sample were compared. Table 2 shows the results thereof.

TABLE 2

| | Carrier generating material | Mixing ratio | Sample name | DD (%) | $E_{600/100}$ (lux · sec) |
|---|---|---|---|---|---|
| Example 7 | A-3/B | 0.999/0.001 | Just-after-production sample | 18.4 | 1.34 |
| | | | Stored sample | 18.7 | 1.36 |
| Example 8 | A-3/B | 0.99/0.01 | Just-after-production sample | 19.3 | 1.29 |
| | | | Stored Sample | 19.8 | 1.31 |
| Example 9 | A-3/B | 0.9/0.1 | Just-after-production sample | 21.5 | 1.26 |
| | | | Stored sample | 22.2 | 1.26 |
| Comparative example 7 | A-3 | 1 | Just-after-production sample | 18.0 | 1.53 |
| | | | Stored sample | 20.6 | 1.86 |

The above-mentioned results show that, when perylene compound B is mixed with perylene compound A, storage stability of the dispersion solution is improved and sensitivity and charge properties are stabilized compared to independent use of perylene compound A.

As is apparent from the above-mentioned examples, it can be understood that the electrophotographic photoreceptor of the present invention has excellent sensitivity properties and stable quality.

What is claimed is:

1. An electrophotographic photoreceptor comprising a conductive support and provided thereon an intermediate layer, a carrier generation layer and a carrier transportation layer containing a carrier transportation material, wherein a first perylene compound represented by Formula A and a second perylene compound represented by Formula B are mixed in said carrier generation layer:

Formula A

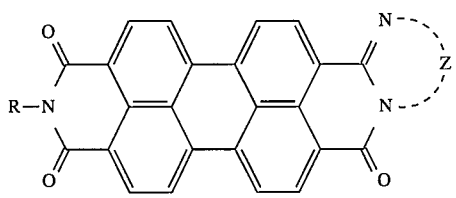

wherein Z represents a substituted or unsubstituted divalent aromatic hydrocarbon group or a substituted or unsubstituted divalent heterocyclic group; and R represents an alkyl group, an aralkyl group, a hydroxyalkyl group, an alkoxyalkyl group, an aromatic hydrocarbon group or a heterocyclic group;

Formula B

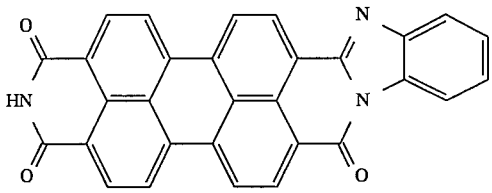

and wherein a weight ratio of said first perylene compound represented by Formula A to said second perylene compound represented by Formula B is a ratio of 9/1 to 999/1.

2. The electrophotographic photoreceptor of claim 1, wherein said Z in Formula A represents a phenylene group, a naphthylene group, an anthracenediyl group, a phenanthlenediyl group, a pyrydinediyl group, a pyrimidinediyl group or an anthraquinononediyl group, and said R of said first perylene compound represents an alkyl group having 1 to 6 carbon atoms or an aralkyl group having 7 to 10 carbons.

3. The electrophotographic photoreceptor of claim 1, wherein said carrier transportation material is selected from a group consisting of compounds represented by Formulas 3, 4, 5 and 6:

Formula 3:

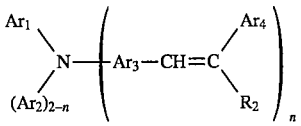

wherein $Ar_1$, $Ar_2$, $Ar_3$ and $Ar_4$ each represent an aromatic hydrocarbon group or a heterocyclic group; $R_2$ represents a hydrogen atom or an aromatic hydrocarbon group or a heterocyclic group; n is 1 or 2; and $Ar_4$ and $R_2$ may combine with each other to form a condensed ring system;

Formula 4:

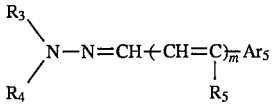

wherein $R_3$ and $R_4$ each represent an aromatic hydrocarbon group, a heterocyclic group or alkyl group, which may combine with each other to form a condensed ring system; $R_6$ represent a hydrogen atom or an aromatic hydrocarbon group, a heterocyclic group or an alkyl group; $Ar_5$ represents an aromatic hydrocarbon group or a heterocyclic group; and m is 0 or 1;

Formula 5:

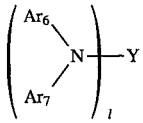

wherein Y represents a benzene, naphthalene, pyrene, fluorene or carbazole; $Ar_6$ and $Ar_7$ each represent an aromatic hydrocarbon group or a heterocyclic group; and 1 is 1 to 3;

Formula 6:

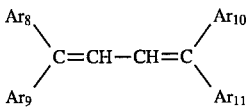

wherein $Ar_8$, $Ar_9$, $Ar_{10}$ and $Ar_{11}$ each represent an aromatic hydrocarbon group or a heterocyclic group.

* * * * *